US008678611B2

(12) United States Patent
Chu et al.

(10) Patent No.: US 8,678,611 B2
(45) Date of Patent: Mar. 25, 2014

(54) LIGHT EMITTING DIODE LAMP WITH LIGHT DIFFUSING STRUCTURE

(75) Inventors: Sidney Chun Kit Chu, Kowloon (HK); Oon Siang Ling, Penang (MY); Low Kean Choong, Penang (MY); Chew Tong Fatt, Penang (MY)

(73) Assignee: GT Biomescilt Light Limited, Kowloon (HK)

( * ) Notice: Subject to any disclaimer, the term of this patent is extended or adjusted under 35 U.S.C. 154(b) by 215 days.

(21) Appl. No.: 13/217,911

(22) Filed: Aug. 25, 2011

(65) Prior Publication Data

US 2013/0050998 A1 Feb. 28, 2013

(51) Int. Cl.

| | |
|---|---|
| ***F21V 1/00*** | (2006.01) |
| ***F21V 5/00*** | (2006.01) |
| ***F21V 7/00*** | (2006.01) |

(52) U.S. Cl.

USPC ..... 362/217.05; 362/217.01; 362/218; 362/225; 362/217.02; 362/249.02; 313/110; 313/113; 313/116

(58) Field of Classification Search

USPC ..... 362/217.01–217.05, 218–225, 227, 362/235, 249.01–249.02, 257, 326, 335; 313/110–117, 25–27, 317, 313/318.01–318.09, 483–493, 567–577, 313/623, 627–643; 439/615, 739, 24, 26, 439/29; 445/22, 24, 26, 29

See application file for complete search history.

(56) References Cited

U.S. PATENT DOCUMENTS

| | | | | |
|---|---|---|---|---|
| 5,971,565 | A * | 10/1999 | Zapata et al. | 362/294 |
| 5,976,686 | A | 11/1999 | Kaytor et al. | |
| 2006/0193131 | A1* | 8/2006 | McGrath et al. | 362/227 |
| 2008/0037239 | A1* | 2/2008 | Thomas et al. | 362/92 |
| 2010/0079075 | A1* | 4/2010 | Son | 315/152 |
| 2010/0109558 | A1 | 5/2010 | Chew | |
| 2011/0044036 | A1* | 2/2011 | Cui et al. | 362/235 |
| 2011/0235318 | A1* | 9/2011 | Simon et al. | 362/217.05 |
| 2012/0176785 | A1* | 7/2012 | Hsu | 362/218 |

FOREIGN PATENT DOCUMENTS

| | | | |
|---|---|---|---|
| CN | 201764293 | U | 3/2011 |
| DE | 10349788 | A1 | 5/2005 |
| TW | 201017061 | A | 5/2010 |
| WO | WO-2008/078077 | A1 | 7/2008 |

OTHER PUBLICATIONS

International Search Report and Written Opinion issued in International Patent Application No. PCT/IB2012/001633 mailed Dec. 5, 2012.

* cited by examiner

*Primary Examiner* — Donald Raleigh

(74) *Attorney, Agent, or Firm* — McDermott Will & Emery LLP

(57) ABSTRACT

A light emitting diode (LED) lamp includes a tube having a transparent first section and an opaque second section. An LED disposed inside of the tube. The second section is has an inner surface having a light diffusive surface so that the LED light is diffusively reflected. The LED is disposed so that a total amount of direct light from the LED to the first section is smaller than a total amount of indirect light that is incident on the first section as a result of being reflected by the second section (i.e., scattered or diffused light). The LED is disposed so that a light axis of the LED points toward the inner surface of the second section.

36 Claims, 14 Drawing Sheets

LIGHT EMITTING DIODE LAMP WITH LIGHT DIFFUSING STRUCTURE

TECHNICAL FIELD

The present disclosure relates to an LED (light-emitting diode) lamp (light tube). More specifically, the present disclosure relates to an LED lamp which includes light diffusing structures to suppress direct light of LEDs from being emitted outside the lamp, thereby reducing glare.

BACKGROUND

Recently, a light-emitting diode (LED) light tube has been developed and has become popular as a replacement of a fluorescence light tube, because of its low power consumption and long life characteristic. FIG. 1 shows a configuration of a conventional LED light tube. The LED light tube 100 includes a plurality of LEDs 101 and a printed circuit board (PCB) 103 on which the plurality of LEDs 101 are disposed. An aluminum tube cover 105 constitutes a bottom half of the LED light tube and a transparent plastic tube cover 107 constitutes a top half of the LED light tube. The LED light tube 100 further includes an LED driver circuit 109 that is typically located underneath the PCB 103, and two end-caps 111 with bi-pins 113 for electrical contact.

FIG. 2 shows a cross sectional view of the conventional LED light tube 100 as shown in FIG. 1. The PCB 103 is slotted into grooves 121 formed on the inside of the tube, for example, inside of the aluminum tube cover 105. As shown in FIG. 2, the LEDs 101 are upwardly disposed so that light emitted from the LEDs 101 directly reaches the transparent plastic tube cover 107 and passes through the transparent plastic tube cover 107 to outside of the LED light tube 100.

In the above configuration of the conventional LED light tube, however, "glare" becomes one of the problems. Glare is caused when a bright light source appears in the foreground, superimposed on the background with lower brightness. Since the eyes are initially adapted to the background with low brightness, contrast against the bright light source generates vision discomfort or vision disability to the eyes.

FIG. 3 shows the glare caused by a lamp 131, e.g., a fluorescent lamp tube or bulb, with a shade. To reduce the glare in a conventional light source, a lamp shade 133 or a louver 135 has been used to provide a sharp cutoff angle from the bulb or tube. The cutoff angle "a" is frequently set to cut off the light sharply from 45 degrees upwards. At position 1 of FIG. 3, the observer 137 from afar is shielded from the bulb by the shade 133, and at position 2, as the observer 137 approaches nearer to the cutoff angle "a", the observer 137 suddenly sees the bulb directly. At position 3, the observer 137 experiences the direct glare if the observer 137 deliberately tilts the head up while walking underneath the lamp 131. When the conventional LED light tube having the transparent cover as shown in FIGS. 1 and 2 is used as the lamp 131, the light emitted from the LEDs will be more visible from afar than the lamp with a shade or louver, even at a near horizontal angle, causing discomforting glare.

To overcome the glare problem, the conventional LED light tube has utilized a semi-transparent plastic cover or prismatic features that disperses the light as it passes through the cover. However, such a semi-transparent cover or prismatic structured cover absorbs a significant amount of light, thereby reducing the overall lumen/watt efficiency of the LED light tube.

Heat dissipation from the LEDs is another problem in the conventional LED light tube. In the conventional LED light tube 100, the heat generated at the LEDs 101 is dissipated away from the LEDs 100 through the PCB 103 to the grooves 121 of the aluminum tube cover 105 as shown in FIG. 2. From the aluminum tube cover 105, as well as the plastic tube cover 107, the heat is dissipated by means of external convection. Since the heat dissipation path from the LEDs to the aluminum tube cover 105 is long, the efficiency of the heat dissipation in the conventional LED light tube is not sufficient.

Further, a driver circuit 109 for the LEDs of the conventional LED light tube typically includes a switched mode power supply (SMPS) with an AC to DC conversion function at high frequency and with a low voltage output, together with other components. As such, the size of the driver circuit 109 in the conventional LED light tube becomes so large that it has to be located in a space between the PCB 103 and the aluminum cover tube 105 (see, FIG. 2). Since the driver circuit 109 is located under the PCB 103, a half of the tube is not effectively utilized.

Accordingly, there is a need for an LED light tube which can suppress the uncomfortable glare and obtain better heat dissipation efficiency, which overcomes one or more of the foregoing problems.

SUMMARY

In order to solve one or more of the foregoing problems associated with the conventional LED light tube, the present disclosure addresses the needs for preventing glare in the LED light tube and obtaining better heat dissipation. An LED light tube of the present disclosure reduces glare by shielding most of the direct light from the LEDs from the observer, and by extracting diffused light from the LED light tube which scatters on the inner surface of the LED light tube.

In one exemplary embodiment, a light emitting diode (LED) lamp comprises a tube having a first section and a second section, and LEDs disposed inside of the tube. The first section is transparent or substantially transparent with respect to LED light emitted from the LED, and the second section is opaque with respect to the LED light and has an inner surface having a light diffusive surface so that the LED light is diffusively reflected, i.e., the LED light is scattered or diffused in reflecting at the inner surface. The LEDs are disposed so that a total amount of direct light from the LEDs to the first section is smaller than a total amount of indirect light that is incident on the first section as a result of being reflected by the second section (i.e., scattered or diffused light) and/or other portions inside tube. In the above LED lamp, the first section may be a first half tube and the second section may be a second half tube.

In one or more of the above LED lamps, a transmittance of the first half tube with respect to the light emitted from the LEDs is 80% ore more (i.e., transparent or substantially transparent). Alternatively, the transmittance of the first half tube with respect to the light emitted from the LEDs may be from 40% to 80% (i.e., semi-transparent).

In one or more of the above LED lamps, the first and second half tubes are made of a plastic material. In the alternative, the first half tube may be made of a plastic material and the second half tube may be made of a metal material, for example, aluminum or an aluminum alloy. Aluminum or an aluminum alloy may be provided as a sheet disposed on the inner surface of the second half tube that is made of, for example, a plastic material.

In one or more of the above LED lamps, the first and second half tubes (or the first and second sections) form a contiguous space that provides a light mixing chamber for mixing the direct light and the indirect light.

In one or more of the above LED lamps, at least one of the first half tube and the second half tube (or the first and second sections) has a gutter-like shape having a half-round cross section.

In one or more of the above LED lamps, the first half tube and the second half tube (or the first and second sections) have two first engaging portions and two second engaging portions, respectively, for engaging the first half tube and the second half tube to constitute the tube. The respective second engaging portions extend toward inside of the tube, and the LEDs are disposed on at least one of the second engaging portions. The plurality of LEDs may be disposed on the two second engaging portions, respectively.

When the LEDs are disposed on the surface of the second engaging portion, an angle, which is a smaller one of the angles between a normal line of the surface and a horizontal line, is 45° or more and 90° or less. It is noted that the horizontal line is a line drawn between the two first engaging portions (or the two second engaging portions).

In one or more of the above LED lamps, the second half tube includes a heat dissipating portion disposed at an outer surface of the second half tube. The heat dissipating portion may include a fin extending from the outer surface of the second half tube. The heat dissipating portion may be disposed on an entire outer surface of the second half tube. The heat dissipating portion may be disposed on at least a part of the outer surface of the second half tube corresponding to one of the second engaging portions.

In one or more of the above LED lamps, at least one of the second engaging portions has a U-shaped portion, and the heat dissipating portion is disposed on an inside portion of the U-shaped portion.

In one or more of the above LED lamps, the inner surface of the second half tube is coated with white pigment. The white pigment includes at least one of barium sulfate, zinc oxide and titanium oxide. In addition or in the alternative, the inner surface of the second half tube may be covered with a light diffusive layer. In addition or in the alternative, the inner surface of the second half tube may be textured so that the LED light is diffusively reflected.

In one or more of the above LED lamps, at least or only a round portion of the inner surface of the second half tube has the light diffusive structure as set forth above. At least a portion of the inner surface of the second half tube to which the LED light directly irradiates has the light diffusive surface. An entirety of the inner surface of the second half tube may be the light diffusive surface.

In one or more of the above LED lamps, the LEDs are mounted on a circuit board. The circuit board is disposed on the surface of the second engaging portion. The plurality of LEDs may be mounted on one or more circuit boards.

In one or more of the above LED lamps, the LEDs include different color LEDs or different color temperature LEDs.

In one or more of the above LED lamps, the LED lamp further comprises an LED driver circuit including a current limiting diode. The LED lamp may further comprise an end cap having a cavity and disposed at an end of the tube. In such a case, the LED driver circuit is disposed on a driver circuit board separately provided from the circuit board, and the driver circuit board is disposed in the cavity of the end cap. The LED driver circuit may be integrated into the circuit board.

In one or more of the above LED lamps, the circuit board may include a metal core.

In another exemplary embodiment, an LED lamp comprises a tube having a first section and a second section, and LEDs disposed inside of the tube. The first section is transparent or substantially transparent with respect to LED light emitted from the LEDs. The second section is opaque with respect to the LED light and has an inner surface having a light diffusive surface so that the LED light is diffusively reflected. The LEDs are disposed so that a light axis of each of the LEDs points toward the inner surface of the second section. The first section may be a first half tube and the second section may be a second half tube.

Each of the LED has a maximum intensity along the light axis. In other words, the LEDs are disposed so that the light having the maximum intensity points toward the inner surface of the second section. The LED are disposed so that a light ray emitted from each of the LEDs with an angle of 80° or more may reach directly to the first half tube.

In yet another exemplary embodiment, an LED lamp includes a hollow member, LEDs disposed inside of the hollow member and a reflector disposed inside the hollow member. The LEDs are disposed so that a light axis of each of the LEDs points toward the reflector. A surface of the reflector on which light emitted from the LEDs is incident has a structure to diffuse or scatter the incident light. The hollow member may include a first section and a second section. The first section is transparent or substantially transparent with respect to the light emitted from the LEDs and the second section has higher heat conductivity than the first section. The surface of the reflector is textured, includes white fillers or is coated with white pigment so as to diffuse or scatter the incident LED light. The hollow member may be a tube having a substantially (i.e., not necessarily perfectly) circular cross section, a substantially oval cross section, or a substantially rectangular cross section.

The LED lamp of the present disclosure, together with further objects and advantages, can be better understood by reference to the following detailed description and the accompanying drawings.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Figure 4:
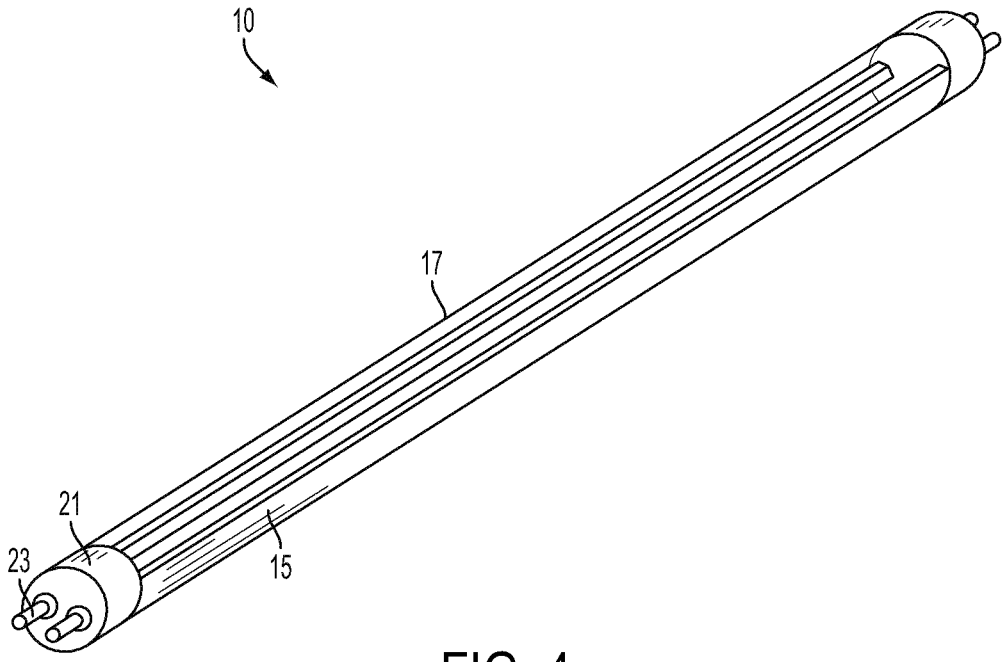
FIG. 4 shows an exemplary view of an LED lamp (light tube) according to one embodiment of the present disclosure.
Figure 6A:
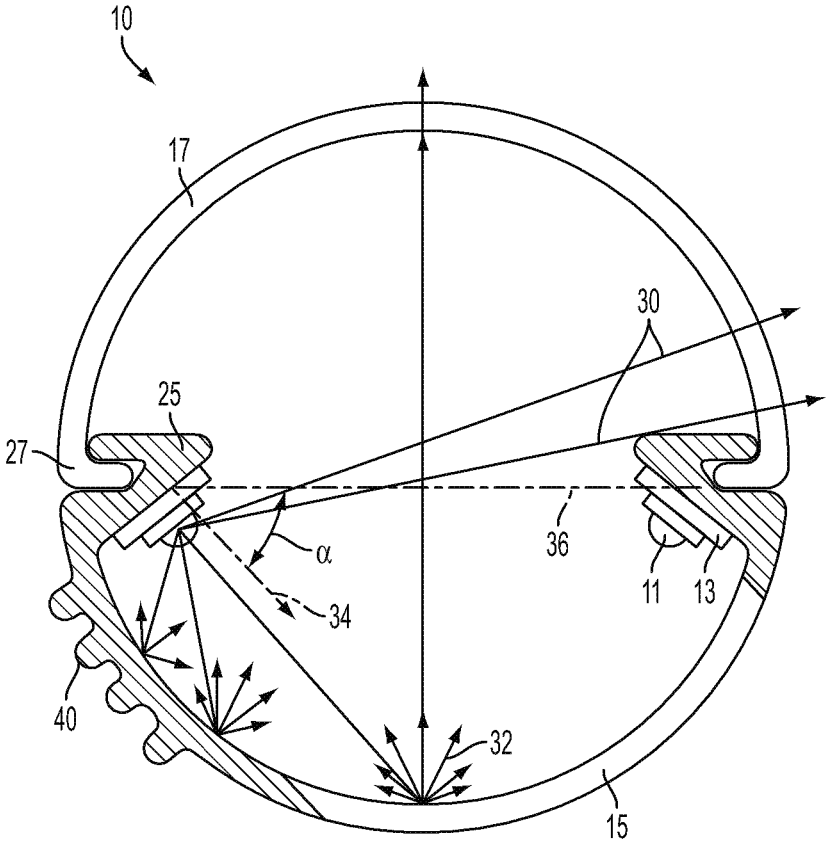
FIG. 6 shows an exemplary cross sectional view of an LED lamp according to one embodiment of the present disclosure.
Figure 6B:
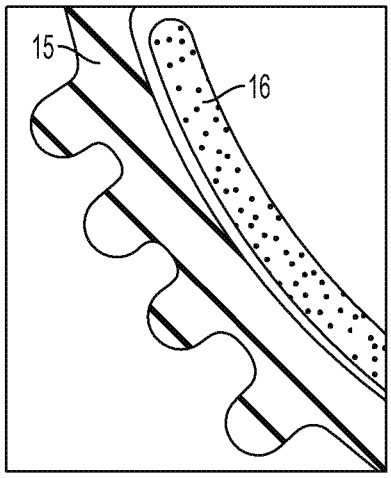

FIG. 4 shows an exemplary view of an LED lamp (light tube) and FIGS. 6A and 6B show an exemplary cross sectional view of the LED lamp according to one embodiment of the present disclosure. An LED lamp 10 includes a transparent or a substantially transparent half tube 17 as a first section, an opaque half tube 15 as a second section, one or more LEDs 11 disposed inside of the LED lamp 10, and a printed circuit board (PCB) 13 on which the LEDs 11 are disposed. The first half tube 17 and the second half tube 15 engage with each other, thereby constituting a light tube as a light mixing chamber. Transparent or substantially transparent means that a transmittance of the first half tube with respect to the light emitted from the LED is 80% or more. The first half tube 17 may be semi-transparent, in which a transmittance of the first half tube with respect to the light emitted from the LED is from 40% to 80%. The LED lamp 10 further includes two end-caps 21 with bi-pins 23 for electrical contact.

The PCB 13 is a metal-core PCB or a core-less PCB. The metal-core PCB enables better heat dissipation away from the LEDs. The PCB 13 is made of, for example, a glass-reinforced resin material.

The first half tube 17 is made of a plastic material having a high deflection temperature, for example but not limited to, polycarbonate or acrylic so that the first half tube 17 withstands heat generated by the LED or inside circuitry. The second half tube 15 is made of a metal material, for example but not limited to, aluminum or an aluminum alloy (for example but not limited to, extruded aluminum or an extruded aluminum alloy). The inside of the second half tube 15 (i.e., the inner surface) is a light diffusive surface so that the LED light is diffusively reflected or scattered. The inner surface of the second half tube 15 is coated with white pigment, for example but not limited to, barium sulfate, zinc oxide or titanium oxide. In addition or in the alternative, the inner surface of the second half tube 15 may be textured so that the LED light is diffusively reflected.

In the alternative, the second half tube 15 may be made of a metal material (e.g., aluminum) with a plastic curved sheet (e.g., polycarbonate or acrylic) as a light diffusive layer 16 provided inside of the second half tube 15 (see, FIG. 6B). The light diffusive layer 16 has a textured surface, includes white fillers (e.g., barium sulfate, zinc oxide or titanium oxide) or is coated with white pigment. The light diffusive layer 16 is bonded to an aluminum extrusion of the second half tube 15 by means of a suitable bonding material such as epoxy or silicone. The light diffusive layer 16 can also be secured to the aluminum extrusion by mechanically wedging the light diffusive layer 16 between the inner surfaces of the second half tube 15.

In FIG. 6A, the sizes of the first half tube 17 and the second half tube 15 are substantially equal, i.e., the cross sections of the first half tube 17 and the second half tube 15 are substantially semi-circular. However, it is possible to make the size of the second half tube 15 larger or smaller in cross section than the size of the first half tube 17. When the size of the second half tube 15 is larger in cross section than that of the first half tube 17, flexibility in arranging the LEDs inside the light tube increases. When the size of the second half tube 15 is smaller in cross section than that of the first half tube 17, a view angle of the LED lamp increases.

As shown in FIG. 6A, the first half tube 17 and the second half tube 15 include two first engaging portions 27 and two second engaging portions 25, respectively, for engaging the first half tube 17 and the second half tube 15 to constitute the light tube. The second engaging portions 25 have concave portions for receiving convex portions of the first engaging portion 27. In the alternative, the second engaging portions 25 may have convex portions for receiving concave portions of the first engaging portion 27.

Figure 5:
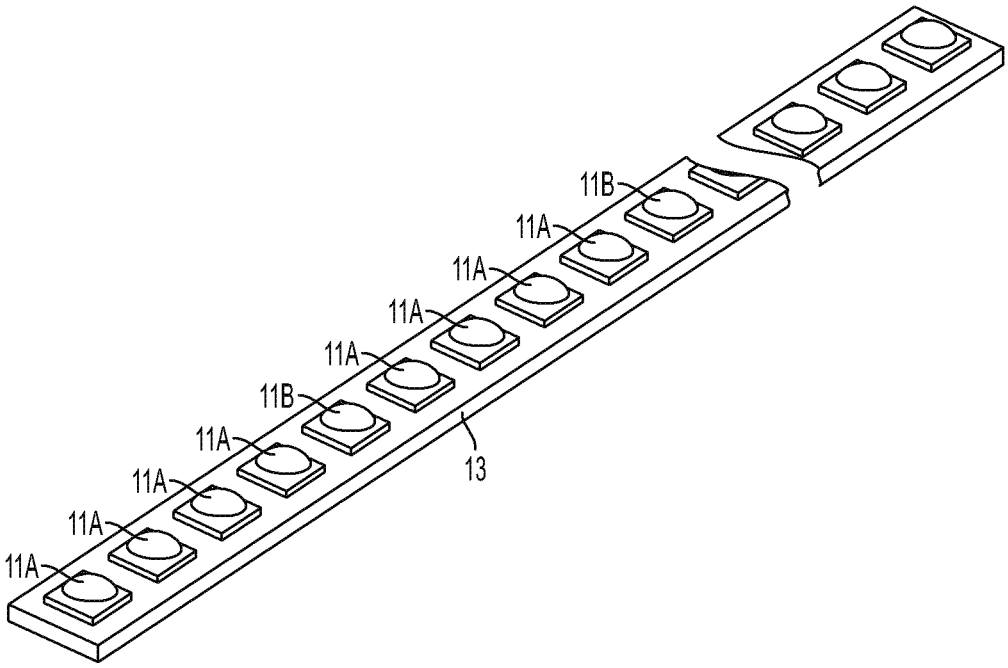
FIG. 5 shows an exemplary view of a printed circuit board (PCB) with a plurality of LEDs according to one embodiment of the present disclosure.

The second engaging portions 25 extend toward inside of the light tube from the second half tube 15. The LEDs 11 are disposed on at least one of the second engaging portions 25. In FIG. 6A, the LEDs 11 are disposed on a printed circuit board (PCB) 13 as shown in FIG. 5, and the PCB 13 is disposed on one of the second engaging portions 25. FIG. 6A illustrates the case where plural LEDs 11 (i.e., two PCBs 13) are disposed on both of the second engaging portions 25.

When the LED 11 is disposed on the second engaging portion 25 in this embodiment, the LED is disposed so that a total amount of direct light 30 from the LED to the first half tube 17 is smaller than a total amount of indirect light 32 (i.e., reflected light) that is incident on the first half tube 17 as a result of being reflected or scattered by the second half tube 15. For example, the LED is disposed so that the light axis of the LED points toward the inner surface of the second half tube 15. As shown in FIG. 6A, most of light emitted from the LED 11 is incident on the inner surface of the second half tube 15 and is reflected at the inner surface of the second half tube 15. The reflected light 32 then travels to the first half tube 17 and is emitted to the outside of the LED lamp 10. The indirect reflected light 32 includes any light reflected inside of the light tube regardless of the number of times of reflection which eventually reaches the first half tube 17. On the other hand, the amount of the direct light 30 is limited, since the light axis of the LED points toward the inner surface of the second half tube 15 and all or most of the direct light is prevented from directly reaching the first half tube by obstacles, for example, the second engaging portions 25.

An inclination angle $\alpha$ as shown in FIG. 6A is defined as an angle which is a smaller one of the angles between a normal line 34 of the surface of the second engaging portion 25 on which the LED 11 (or the PCB 13) is disposed and a horizontal line 36 which is a line drawn between two second engaging portions 25 (or two first engaging portions 27). This inclination angle $\alpha$ is set from 90° (i.e., PCB 13 is disposed so as to be in parallel with the horizontal line 36 and to face the second half tube 15), to about 30°, more preferably 45°. The inclination angle $\alpha$ is selected such that a substantial amount of light emitted from the LED 11 is directed towards the inner surfaces of the second half tube 15 and an amount of direct light towards the first half tube 17 is minimized, thereby minimizing the direct light observed from outside the LED lamp 10 which causes glare to the observer. In other words, since the most of the light emitted from the LED lamp 10 is reflected, diffused or scattered light, the observer will not experience the uncomfortable glare caused by the direct light from a light source. To an observer, almost all of the surface areas which are visible through the transparent first half tube 17 are white reflective surfaces, since the LED 11 and PCB 13 are shielded from the observer's view. As such, the LED lamp 10 can function as an almost uniform white light source, similar to a fluorescent lamp.

Figure 14A:
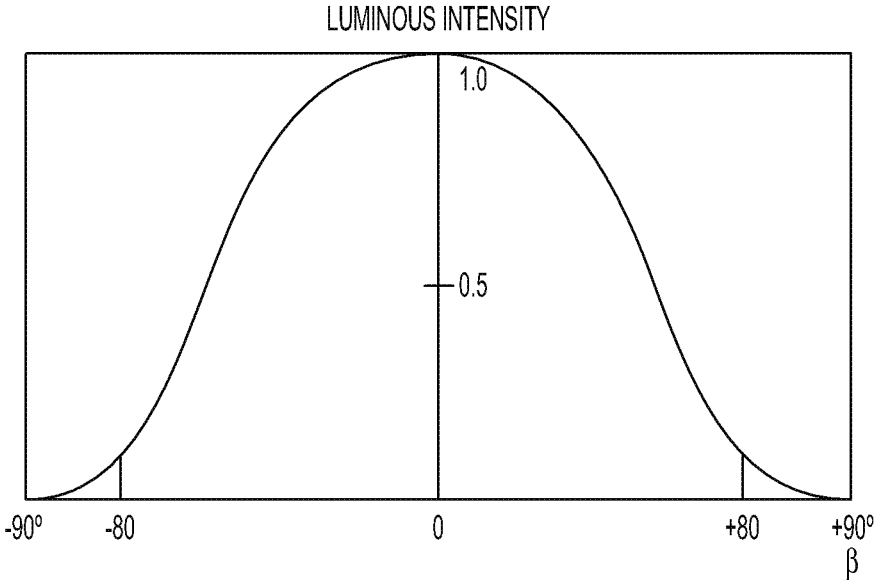
FIG. 14 shows an example of a radiation pattern of an LED.
Figure 14B:
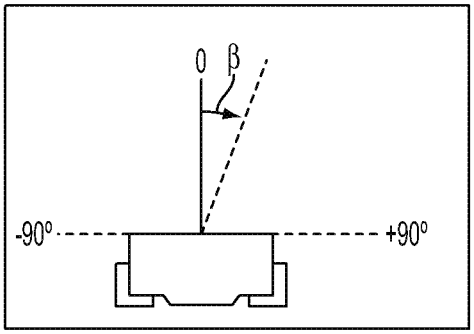

A typical LED, specifically a white LED, has a viewing angle (2β) of about 120° (see, FIG. 14B). The viewing angle is defined as an angle at which a light intensity becomes 50% of the maximum light intensity of the LED. In such a beam pattern, when the angle β becomes about 80°, the light intensity becomes about less than 10% of the maximum light intensity (see, FIG. 14A). Accordingly, the inclination angle α is selected to be at least 80° so that a major portion of the emitted light (intensity of 10-100% of the maximum light intensity) is directed towards the internal surface of the second half tube 15, while only a very small proportion of the light (intensity of less than 10% of the maximum light intensity) directly reaches to the transparent first half tube 17 and goes therethrough. In other words, the light emitted from the angle β of less than 80° inclination from the vertical optical axis needs to be shielded from direct view of the observer to minimize the glare, since the amount of light emitted from the angle β of more than 80° is minimal and does not contribute much to cause the glare.

In this embodiment, the first half tube 17 is transparent or substantially transparent. In another embodiment, the first half tube 17 may be semi-transparent, in which a transmittance of the first half tube 17 with respect to the light emitted from the LED is from 40% to 80%. This semi-transparency enables a part of the light out-going through the first half tube 17 to be reflected back into the light tube (i.e., the light mixing chamber). As a result, the light is re-cycled inside the light mixing chamber and re-reflected from the interior surfaces of the light mixing chamber. With this structure, the luminance of the background that surrounds the LED 11 is increased, thereby further reducing the glare.

Another advantage of this re-cycling of light is improving a light mixing efficiency of multi-colored LEDs mounted inside the LED lamp. FIG. 5 shows an exemplary view of a PCB 13 with a plurality of LEDs 11. In one embodiment, the LEDs 11 include only white LEDs. In another embodiment, however, the LEDs 11 include white LEDs 11A and other color LEDs such as amber, and/or red LEDs 11B. In yet another embodiment, the LEDs 11 includes white LEDs of different color temperatures. The color temperature of the LED describes the color of the light emitted from the LED, ranging from low color temperatures (e.g., red and deep red) to high color temperatures (e.g., bluish white).

A high correlated color temperature (CCT) white LED typically has low color rendering index. Thus, it is common for the high CCT white LED to be mixed with green, yellow, amber and/or red color LEDs to improve the color rendering index of the light source. In such cases, mixing of white LEDs with other colors helps to improve color rendering index of the LED lamp, and enables a wider selection of LEDs to be used.

As shown in FIG. 5, a plurality of white LEDs 11A and a plurality of amber LEDs 11B are disposed on a PCB 13 in an extending direction of the PCB 13. With this feature, large areas of diffused reflective surfaces become available in the LED lamp 10, and color mixing of white with amber is carried out efficiently, thereby making the resultant light be uniformly mixed. The efficiently color-mixed light can be a light source of a single color, rather than that of spots of white and amber individual sources. This improves an external appearance of the LED lamp. Further, it is also possible that color hues are added to white using one or more second color LEDs such as blue and green to provide a uniform off-white colored LED lamp.

While one of the features of the LED lamp according to the above embodiment is suppressing glare, another feature of the LED lamp of the present disclosure is higher heat dissipation efficiency. Reduction in temperature at a p-n junction of LEDs is important because higher temperature will degrade the efficiency of the LEDs and reduce reliability, lumen maintenance and color consistency of the LEDs.

Figure 1:
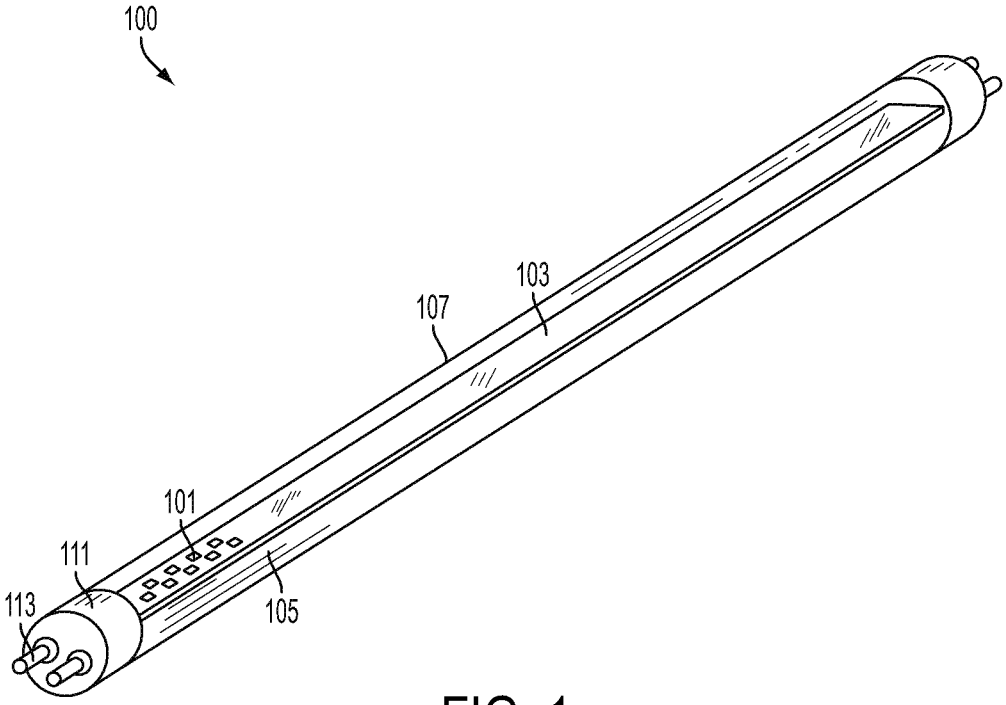
FIG. 1 PRIOR ART
FIG. 1 shows a view of a conventional LED light tube.
Figure 2:
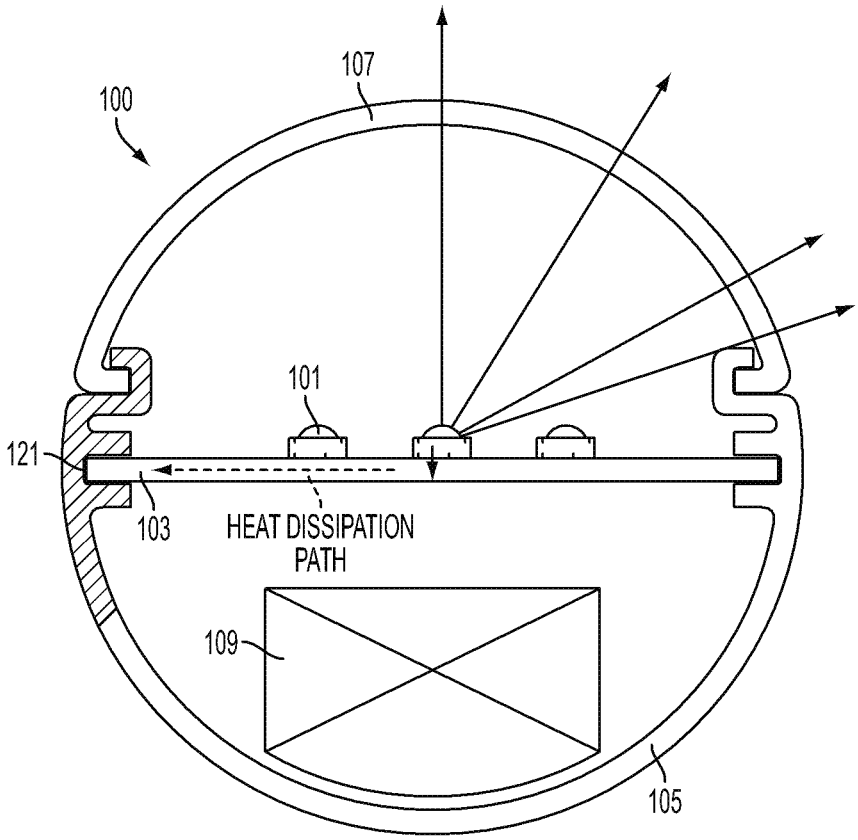
FIG. 2 PRIOR ART
FIG. 2 shows a cross sectional view of the conventional LED light tube.
Figure 3:
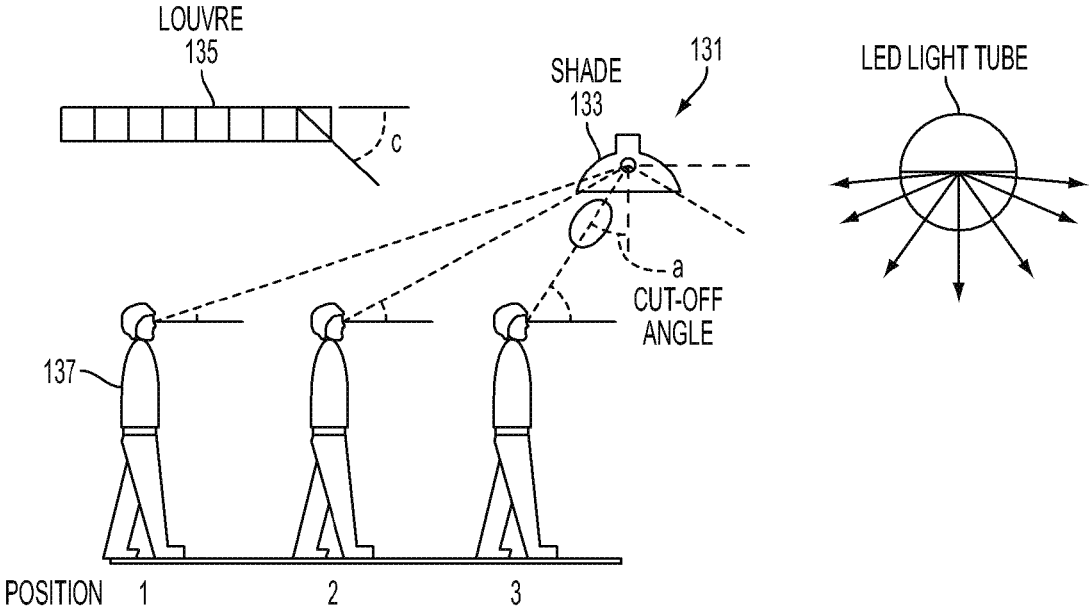
FIG. 3 PRIOR ART
FIG. 3 illustrates a glare problem in the conventional lighting system.

As shown in FIG. 6A, the LED 11 and the PCB 13 are disposed on the second engaging portion 25, which is close to the outer surface of the second half tube 15. Comparing to the conventional LED light tube 100 as shown in FIG. 2, the heat conducting path from the LED 11 to the outer surface the lamp tube is much shorter in FIG. 6A than in FIG. 2. As shown in FIG. 2, the conventional LED light tube 100 uses a wide PCB 103 slotted into the aluminum tube cover 105. The heat generated at the LED 101 first vertically conducts to the PCB 103 and then horizontally conducts to the aluminum tube cover 105 via the groove 121. In contrast, in FIG. 6, the PCB 13, on which the LEDs 11 are mounted, is disposed on the surface of the second engaging portion 25, which is a small protrusion from the second half tube 15 made of, for example but not limited to, aluminum extrusion. With this configuration, a heat dissipation path from the LED 11 to the outside ambient air becomes very short, thereby improving efficiency of conduction of the heat generated by the LED 11.

To more improve the heat dissipation further, the LED lamp of the present disclosure employs cooling fins 40 extending from the outer surface of the second half tube 15. It is preferable that the fins 40 are disposed closer to the second engaging portion 25. In this embodiment, the entire second half tube 15 including the fins 44 are made of aluminum extrusion. However, it is possible that the second engaging portions 25 and the part of the second half tube having the fins near the second engaging portion are made of a metal material.

(First Variation)

Figure 7:
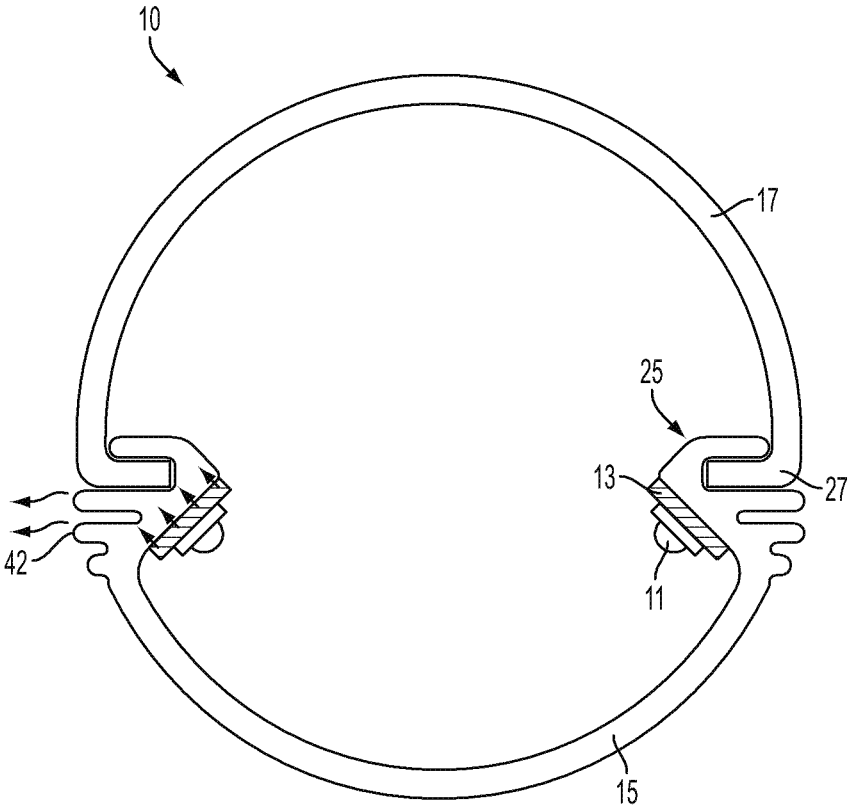
FIG. 7 shows an exemplary cross sectional view of an LED lamp according to a first variation of the present disclosure.

FIG. 7 shows an exemplary cross sectional view of an LED lamp according to a first variation of the present disclosure. In FIG. 7, cooling fins 42 are integrated into the second half tube 15 directly behind the surface where the PCB 13 is mounted. In this configuration, the heat dissipation path is further minimized, thereby improving the heat dissipation efficiency.

Further, the fins 42 are in a horizontal position when the LED lamp 10 is set to lighting fixtures. Since the fins 42 extending horizontally, less dust will be collected or captured by the fins 42 and maintenance or cleaning of the LED lamp becomes easier.

(Second Variation)

Figure 8:
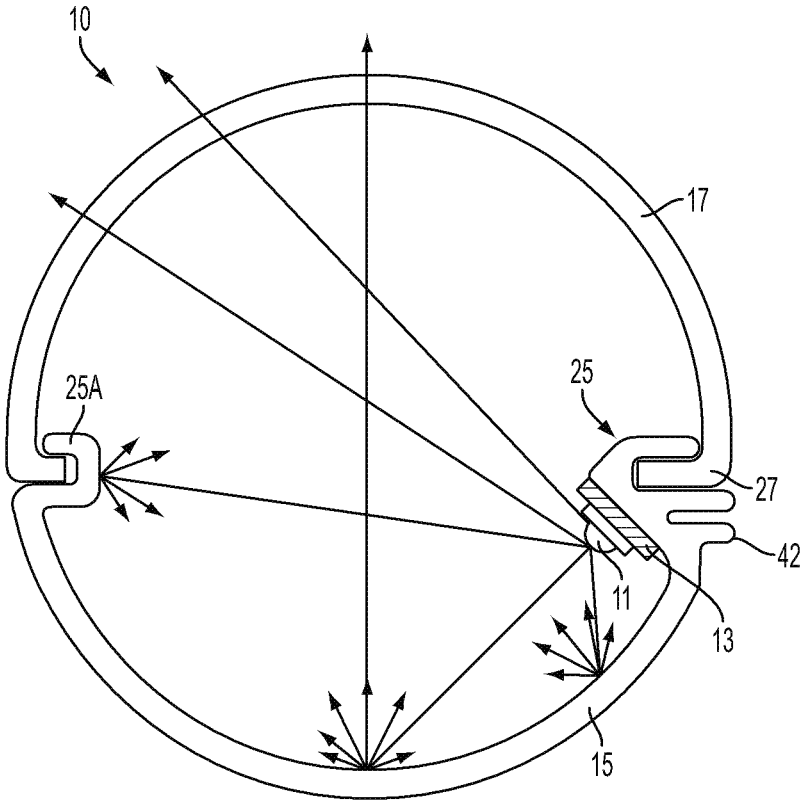
FIG. 8 shows an exemplary cross sectional view of an LED lamp according to a second variation of the present disclosure.

FIG. 8 shows an exemplary cross sectional view of an LED lamp according to a second variation of the present disclosure. In FIG. 8, LEDs 11 and PCB 13 are disposed only on one of the two second engaging portions 25. In this configuration, there are more surface areas for the emitted light to be reflected and diffused inside the light mixing chamber, thereby increasing illumination uniformity and efficiency of the LED lamp 10. For example, the light emitted from the LED 11 is reflected at the second engaging portion 25A and is not absorbed by PCB surfaces or LED surfaces.

(Third Variation)

Figure 9:
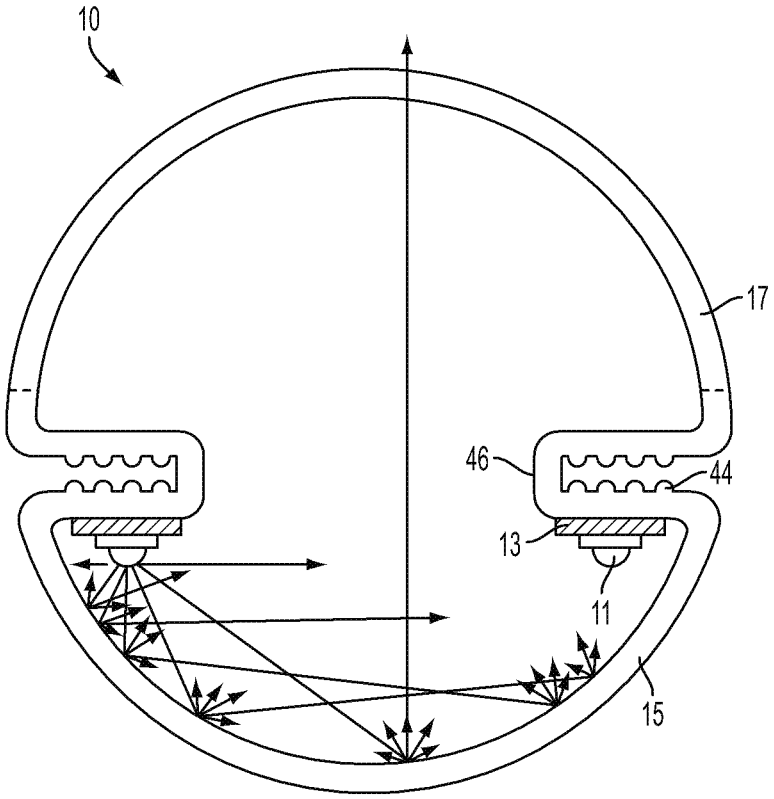
FIG. 9 shows an exemplary cross sectional view of an LED lamp according to a third variation of the present disclosure.

FIG. 9 shows an exemplary cross sectional view of an LED lamp according to a third variation of the present disclosure. One of the features of this variation is that a cooling surface area is maximized near the surface on which the LED 11 and PCB 13 are mounted. With this configuration, heat dissipation is further enhanced. In FIG. 9, the cooling surface area is maximized by having a U-shaped bent portion (or a recess portion) 46 in the second half tube 15 at the location where the PCB 13 is mounted. The external surfaces of the U-shaped bent portion 46 are corrugated, ribbed or formed with cooling fins 44.

In this example, the entire tube is made of a plastic material. The first half tube 17 can be co-extruded with the second half tube 15. The second half tube 15 includes white fillers to provide a diffused reflective surface, as well as to provide a better heat conduction. The first half tube 17 is made of a transparent plastic material. Alternatively, the first half tube 17 can be made of a semi-transparent material to increase light re-cycling and mixing for better light uniformity. Since both of the first and second half tubes are made of plastic, the overall weight of the LED lamp can be reduced, thereby enabling the resulting lamp to comply with weight limits to the LED lamp imposed by regulatory bodies.

(Fourth Variation)

Figure 10:
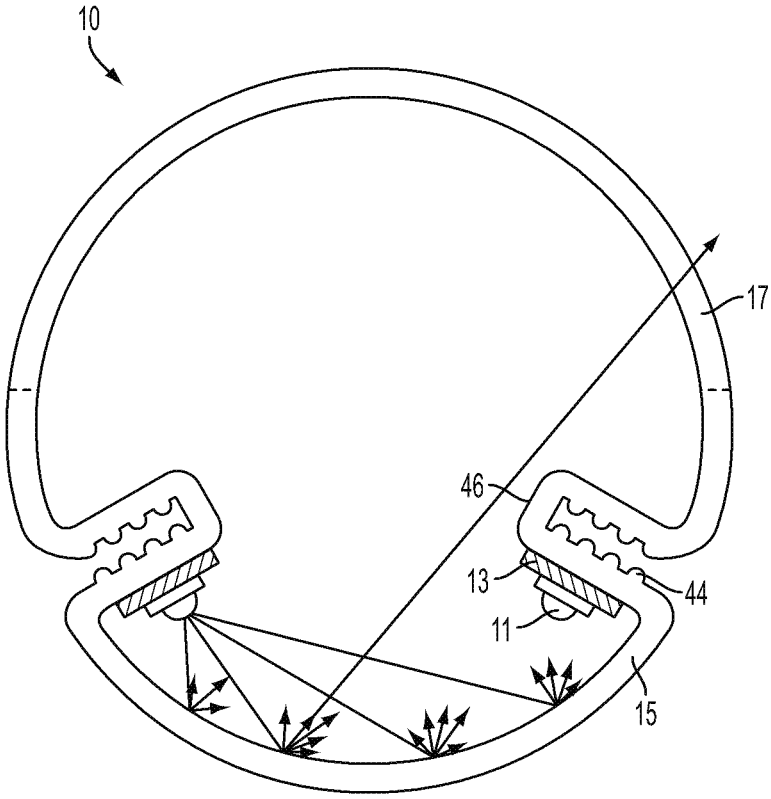
FIG. 10 shows an exemplary cross sectional view of an LED lamp according to a fourth variation of the present disclosure.

FIG. 10 shows an exemplary cross sectional view of an LED lamp according to a fourth variation of the present disclosure. In FIG. 10, the U-shaped bent portion 46 is shifted lower down in the cross-section to provide a better angle of light emission for the LED 11 so as to more efficiently illuminate the inner surface of the second half tube 15.

As shown in FIGS. 14A and 14B, the light intensity of an LED is maximum at its optical axis (i.e., perpendicular to the LED). Thus, the PCB 13 on which the LED 11 is disposed is set at an angle such that the maximum light intensity is directed to the center portion of the second half tube. With this configuration, the light is reflected more at the center portion, and the reflected light can be directly emitted out through the first half tube 17 in a single pass. This configuration can reduce the light that is trapped by the U-shaped bent portion 46 after the first reflection.

Figure 11A:
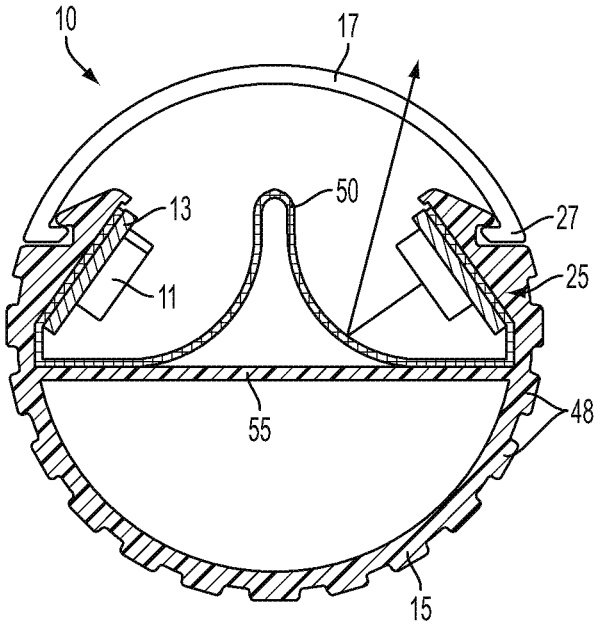
FIG. 11 shows an exemplary cross sectional view of an LED lamp according to another embodiment of the present disclosure.
Figure 11B:
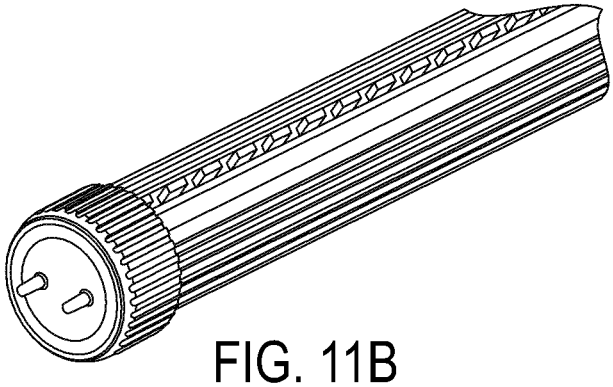

FIG. 11 shows an exemplary cross sectional view of an LED lamp according to another embodiment of the present disclosure. The LED lamp according to this embodiment is substantially similar to the LED lamp of FIG. 6 (e.g., with regard to structure and materials used). However, in the LED lamp 10 according to this embodiment, the light emitted from the LED 11 is not reflected or scattered by the second half tube 15 but is reflected, diffused or scattered by a reflector 50 disposed separately from the second half tube. The LED lamp 10 includes the first half tube 17 and the second half tube 15. The first half tube 17 and the second half tube 15 are engaged by the first engaging portions 27 and the second engaging portions 25 to form a light tube. The second half tube further includes a center support 55. The second half tube 17 is made of a metal material, for example, aluminum extrusion. The center support 55 is also made of the same material as the second half tube 17. The outer surface of the second half tube 17 has heat dissipation structures 48 such as fins or ribs. Similar to FIG. 6, the first half tube 17 is transparent or semi-transparent. The LED 11 is disposed on the PCB 13. A plurality of LEDs 11 are mounted on the PCB 13 and two PCBs 13 are disposed on the surfaces of the second engaging portions 25.

The reflector 50 has a diffusive surface and light incident thereon is scattered or diffused. The surface of the reflector 50 is textured, includes white fillers (e.g., barium sulfate, zinc oxide or titanium oxide) or is coated with white pigment. The reflector 50 is formed into a curved shape so that the light emitted from the LED 11 is reflected and the reflected light is emitted through the first half tube 17 to outside the light tube. In FIG. 11, since there are two lines of LEDs 11 on both sides of the second engaging portions 25, the reflector 50 has a symmetrical conjoined convex shape (e.g., a mountain shape). The end portion of the reflector 50 can be interposed between the PCB 13 and the second engaging portion 25, but this is not necessary. The reflector 50 can be attached by, for example, adhesive, to the center support 55. The reflector 50 is preferably made of a metal material, e.g., an aluminum plate. A driver circuit is located a space between the center support 55 and the second half tube 17.

In FIG. 11, the LED 11 is disposed so that a total amount of direct light from the LED 11 to the first half tube 17 is smaller than a total amount of indirect light that is incident on the first half tube 17 as a result of being reflected by the reflector 50.

(Driver Circuit)

Figure 12:
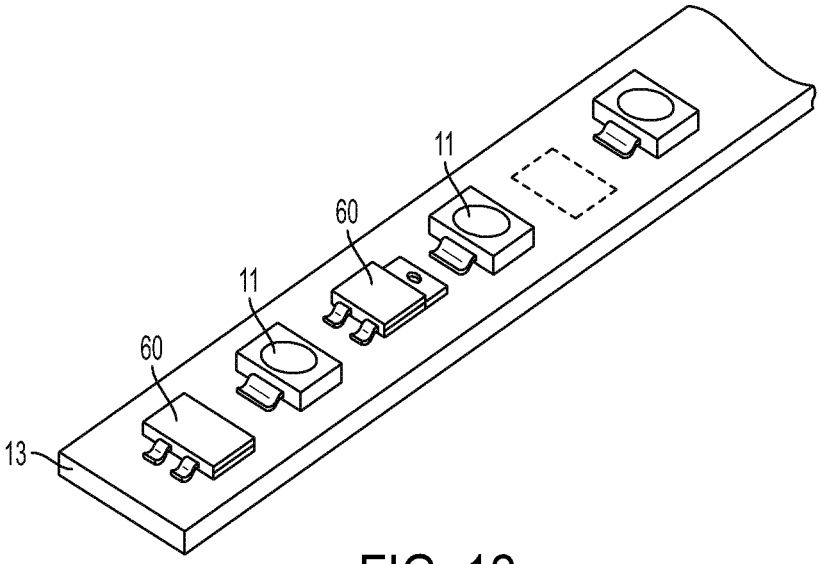
FIG. 12 shows an exemplary PCB according to one embodiment of the present disclosure.

FIG. 12 shows an exemplary PCB according to one embodiment of the present disclosure. The PCB 13 includes LEDs 11 and one or more LED driver circuits 60. Each LED driver circuit 60 employs a current-limiting diode (CLD) based LED driver circuit, thereby making the LED driver circuit small enough to be integrated on the PCB with LEDs. The CLD based LED driver is, for example, a pulsed mode AC to DC driver mentioned in US patent publication US 2010/0109558, the entire contents of which are hereby incorporated by reference.

Figure 13:
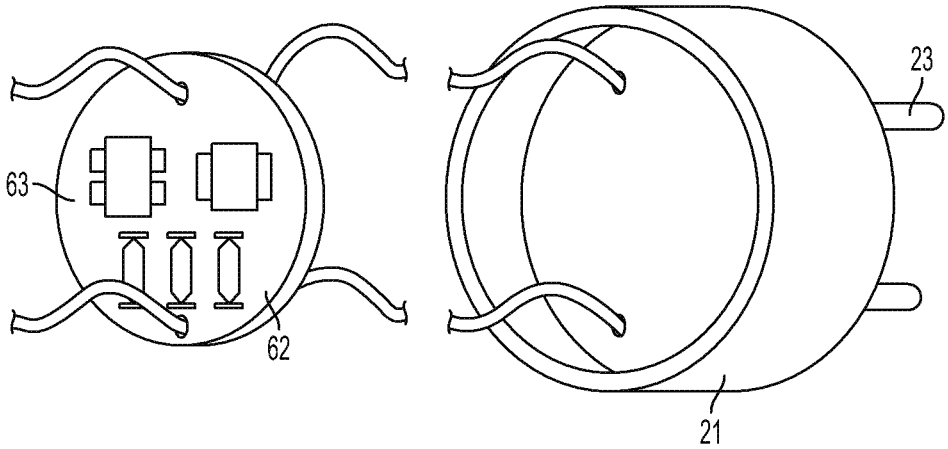
FIG. 13 shows an exemplary PCB according to another embodiment of the present disclosure.

FIG. 13 shows an exemplary PCB according to another embodiment of the present disclosure. In this example, a LED driver circuit 62 including a CLD based LED driver circuit is incorporated into an LED driver PCB 63. This PCB 63 has a circular shape and is fitted into the end-cap 21 of the LED lamp 10. The LED driver circuit 62 receives AC power voltage via bi-pins 23 and outputs a pulsed current for driving LEDs 11 on the PCB 13. Since the size of CLD based LED driver circuit is small, it is possible to provide the LED driver PCB 63 inside the end-cap 21.

One of the advantages of the LED lamps according to the present disclosure is that glare is effectively reduced. Since LEDs are facing inward and downwards, away from the transparent or semi-transparent half tube portion, most of the high intensity light emitted from the LEDs is directed towards a diffusive inner surface of the light tube. The reflected light is scattered or diffused and emits from the light tube as uniform light. Little or no light emitted from the light tube as direct light which is emitted from the LEDs and directly reaches the transparent half tube portion without being reflected. Light from the LED lamp appears as a uniform patch of light from the diffused surface as well as from the secondary reflection surfaces inside the light tube.

Another advantage is that colors are more uniformly mixed. Since the non-white LEDs are interspersed between the white LEDs and the lights are mixed in the LED light tube, uniformity of color mixing is improved.

Yet another advantage is that the LED lamp structure according to the present disclosure improves heat dissipation efficiency. Heat generated at the LEDs conducts more directly to outside the light tube for being subjected to ambient air circulation. The use of cooling fins further improves the heat dissipation.

Further, the LED lamp according to the present disclosure can simplify tube structure and reduce weight and cost. As there is no central PCB spanning the width of the tube, an amount of a PCB material can be reduced. This also reduces the cost and overall weight of the light tube.

Although certain specific examples have been disclosed, it is noted that the present teachings may be embodied in other forms without departing from the spirit or essential characteristics thereof. The present examples described above are considered in all respects as illustrative and not restrictive. The patent scope is indicated by the appended claims, and all changes that come within the meaning and range of equivalency of the claims are therefore intended to be embraced therein.

What is claimed is:

1. A light emitting diode (LED) lamp, comprising:
a tube having a first section and a second section; and
LEDs disposed inside of the tube, wherein:
a transmittance of the first section with respect to LED light emitted from the LEDs is from 40% to 80%,
the second section has an inner surface having a light diffusive surface so that the LED light is diffusively reflected, and
the LEDs are disposed so that a total amount of direct light from the LEDs to the first section is smaller than a total amount of indirect light that is incident on the first section as a result of being reflected by the second section.

2. The LED lamp of claim 1, wherein the first section includes a first half tube and the second section includes a second half tube.

3. The LED lamp of claim 2, wherein the first and second half tubes are made of a plastic material.

4. The LED lamp of claim 2, wherein the first half tube is made of a plastic material and the second half tube is made of a metal material.

5. The LED lamp of claim 2, wherein the first and second half tubes form a contiguous space that provides a light mixing chamber for mixing the direct light and the indirect light.

6. The LED lamp of claim 2, wherein at least one of the first half tube and the second half tube has a gutter-like shape having a half-round cross section.

7. The LED lamp of claim 2, wherein:
the first half tube and the second half tube have two first engaging portions and two second engaging portions, respectively, for engaging the first half tube and the second half tube to constitute the tube, the second engaging portions extending toward inside of the tube, and
the LEDs are disposed on at least one of the second engaging portions.

8. The LED lamp of claim 7, wherein:
the LEDs are disposed on the two second engaging portions, respectively.

9. The LED lamp of claim 7, wherein:
the LEDs are disposed on a surface of the second engaging portion, and
an angle, which is a smaller angle of angles between a normal line of the surface and a horizontal line, the horizontal line being a line drawn between the two first engaging portions, is 45° or more and 90° or less.

10. The LED lamp of claim 7, wherein the second half tube includes a heat dissipating portion disposed at an outer surface of the second half tube.

11. The LED lamp of claim 10, wherein the heat dissipating portion includes a fin extending from the outer surface of the second half tube.

12. The LED lamp of claim 10, wherein the heat dissipating portion is disposed on an entire outer surface of the second half tube.

13. The LED lamp of claim 10, wherein the heat dissipating portion is disposed on at least a part of the outer surface of the second half tube corresponding to one of the second engaging portions.

14. The LED lamp of claim 10, wherein:
at least one of the second engaging portions has a U-shaped portion, and
the heat dissipating portion is disposed on at an inside portion of the U-shaped portion.

15. The LED lamp of claim 2, wherein the inner surface of the second half tube is coated with white pigment.

16. The LED lamp of claim 15, wherein the white pigment includes at least one of barium sulfate, zinc oxide and titanium oxide.

17. The LED lamp of claim 2, wherein the inner surface of the second half tube is covered with a light diffusive layer.

18. The LED lamp of claim 2, wherein the inner surface of the second half tube is textured so that the LED light is diffusively reflected.

19. The LED lamp of claim 2, wherein an entirety of the inner surface of the second half tube has the light diffusive surface.

20. The LED lamp of claim 2, wherein a round portion of the inner surface of the second half tube has the light diffusive surface.

21. The LED lamp of claim 2, wherein a portion of the inner surface of the second half tube to which the LED light directly irradiated has the light diffusive surface.

22. The LED lamp of claim 7, wherein:
the LEDs are mounted on a circuit board, and
the circuit board is disposed on a surface of the second engaging portion.

23. The LED lamp of claim 2, wherein the LEDs are mounted on a circuit board.

24. The LED lamp of claim 23, wherein the LEDs include different color LEDs or different color temperature LEDs.

25. The LED lamp of claim 2, further comprising an LED driver circuit including a current limiting diode.

26. The LED lamp of claim 25, further comprising an end cap having a cavity and disposed at an end of the tube, wherein:
the LED driver circuit is disposed on a driver circuit board separately provided from the circuit board, and
the driver circuit board is disposed in the cavity of the end cap.

27. The LED lamp of claim 23, further comprising an LED driver circuit including a current limiting diode and being integrated into the circuit board.

28. The LED lamp of claim 23, wherein the circuit board includes a metal core.

29. A light emitting diode (LED) lamp, comprising:
a tube having a first section and a second section; and
LEDs disposed inside of the tube, wherein:
a transmittance of the first section with respect to LED light emitted from the LEDs is from 40% to 80%,
the second section has an inner surface having a light diffusive surface so that the LED light is diffusively reflected, and
the LEDs are disposed so that a light axis of each of the LEDs points toward the inner surface of the second section.

30. The LED lamp of claim 29, wherein the first section includes a first half tube and the second section includes a second half tube.

31. The LED lamp of claim 29, wherein each of the LEDs has a maximum intensity along the light axis.

32. The LED lamp of claim 30, wherein each of the LEDs is disposed so that light emitted from each of the LEDs with an angle of 80° or less from the light axis do not reach directly to the first half tube.

33. A light emitting diode (LED) lamp, comprising:
a one-piece hollow member;
LEDs disposed inside of the one-piece hollow member; and
a reflector partially disposed inside the one-piece hollow member, wherein:
each of the LEDs is disposed so that a light axis of each of the LEDs points toward the reflector, a surface of the reflector on which light emitted from the LEDs incidents has a structure to diffuse or scatter the incident light, the one-piece hollow member includes a light transmitting section made of a plastic material which is transparent or substantially transparent with respect to an LED light emitted from the LEDs, and the reflector is not disposed in the light transmitting section, a part of the one-piece hollow member bends toward an inside of the one-piece hollow member so as to form a U-shaped portion, and the LEDs are disposed on an outside portion of the U-shaped portion, the outside portion being a part of an inner surface of the one-piece hollow member.

34. The LED lamp of claim 33, wherein:

a transmittance of the light transmitting section with respect to LED light emitted from the LEDs is from 40% to 80%, the portion on which the reflector is disposed has higher heat conductivity than the light transmitting.

35. The LED lamp of claim 33, wherein the surface of the reflector is textured, includes white fillers or is coated with white pigment.

36. The LED lamp of claim 33, wherein a heat dissipating portion is disposed at an inside portion of the U-shaped portion, the inside portion being a part of an outer surface of the one-piece hollow member.

* * * * *